US012180625B2

(12) United States Patent
Baranek et al.

(10) Patent No.: US 12,180,625 B2
(45) Date of Patent: Dec. 31, 2024

(54) KNITTED COMPONENT HAVING A FOAM SURFACE FEATURE

(71) Applicant: NIKE, Inc., Beaverton, OR (US)

(72) Inventors: Austin Baranek, Beaverton, OR (US); Katharine Fraser, Portland, OR (US); Stephen J. Hipp, Hillsboro, OR (US); James Molyneux, Portland, OR (US); Kristen E. Orme, Portland, OR (US); Margaret P. St. Clair, Beaverton, OR (US); Yang Zhao, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 470 days.

(21) Appl. No.: 16/951,249

(22) Filed: Nov. 18, 2020

(65) Prior Publication Data

US 2021/0148017 A1 May 20, 2021

Related U.S. Application Data

(60) Provisional application No. 62/939,110, filed on Nov. 22, 2019, provisional application No. 62/937,133,
(Continued)

(51) Int. Cl.
*D04B 1/22* (2006.01)
*D04B 1/12* (2006.01)
(Continued)

(52) U.S. Cl.
CPC ..... *D04B 1/16* (2013.01); *D04B 1/123* (2013.01); *D04B 1/22* (2013.01); *D04B 21/20* (2013.01);
(Continued)

(58) Field of Classification Search
CPC ..... D04B 1/12; D04B 1/22; D04B 21/20
See application file for complete search history.

(56) References Cited

U.S. PATENT DOCUMENTS 1,989,617 A * 1/1935 Horrocks ..... D04B 1/02 139/420 R
2,440,393 A 4/1948 Clark
(Continued)

FOREIGN PATENT DOCUMENTS

CA 624083 A 7/1961
CA 2121996 A1 12/1994
(Continued)

OTHER PUBLICATIONS

International Preliminary Report on Patentability for PCT/US2020/061032, mailed Mar. 9, 2022.
(Continued)

*Primary Examiner* — Jenna L Johnson
(74) *Attorney, Agent, or Firm* — Shook, Hardy & Bacon L.L.P.

(57) ABSTRACT

A knitted component may include a first area, where the first area includes a plurality of knit loops comprising a first yarn. The knitted component may also include a second yarn at least partially inlaid within the first area of the knitted component such that the second yarn extends between at least a first loop and a second loop of the plurality of knit loops. The second yarn may have a foamable material comprising a blowing agent and a thermoplastic polymer.

18 Claims, 10 Drawing Sheets

Related U.S. Application Data filed on Nov. 18, 2019, provisional application No. 62/937,117, filed on Nov. 18, 2019, provisional application No. 62/937,092, filed on Nov. 18, 2019.

(51) Int. Cl.
*D04B 1/16* (2006.01)
*D04B 21/20* (2006.01)

(52) U.S. Cl.
CPC .... *D10B 2401/041* (2013.01); *D10B 2401/08* (2013.01); *D10B 2501/043* (2013.01); *Y10T 442/469* (2015.04)

(56) References Cited

U.S. PATENT DOCUMENTS 3,100,926 A * 8/1963 Richmond ..... D03D 15/283 264/45.3
3,249,129 A 5/1966 Renfroe
3,389,446 A 6/1968 Robert
3,694,873 A 10/1972 Crowley
3,847,719 A 11/1974 Crowley
4,144,371 A 3/1979 Okie et al.
4,197,345 A 4/1980 Worrall
4,265,972 A 5/1981 Rudner
4,561,128 A 12/1985 Zimmerman
4,741,941 A 5/1988 Englebert et al.
4,777,080 A 10/1988 Harris et al.
4,803,109 A 2/1989 Saniscalchi
5,445,693 A 8/1995 Vane
5,568,779 A 10/1996 Wong
5,950,554 A 9/1999 Wong
6,007,911 A 12/1999 Bowen, Jr.
6,054,078 A 4/2000 Lauer et al.
6,225,243 B1 5/2001 Austin
6,261,679 B1 7/2001 Chen et al.
6,430,844 B1 8/2002 Otis et al.
6,541,403 B2 4/2003 Billarant et al.
6,548,166 B2 4/2003 Figuly et al.
6,896,843 B2 5/2005 Topolkaraev et al.
6,911,502 B2 6/2005 Vedula
7,081,221 B2 7/2006 Paratore et al.
7,357,889 B2 4/2008 Vedula et al.
7,462,573 B2 12/2008 Tsujiyama et al.
7,785,509 B2 8/2010 Perera et al.
8,034,873 B2 10/2011 Siddhamalli
8,148,475 B2 4/2012 Vedula et al.
8,800,172 B2 8/2014 Dua et al.
8,865,052 B2 10/2014 Makal et al.
9,060,562 B2 6/2015 Meir et al.
9,320,312 B2 4/2016 Lyttle et al.
9,545,773 B2 1/2017 Hansen
9,688,805 B2 6/2017 Vedula et al.
9,723,890 B2 8/2017 Long et al.
9,856,599 B2 1/2018 Park
9,915,026 B2 3/2018 Park
9,963,806 B2 5/2018 Vedula et al.
10,455,885 B2 10/2019 Tamm
10,590,569 B2 3/2020 Hansen et al.
10,590,571 B2 3/2020 Hansen et al.
2001/0044477 A1 11/2001 Soane et al.
2002/0070471 A1 6/2002 Lee et al.
2002/0156225 A1 10/2002 Onder
2002/0161159 A1 10/2002 Vedula
2002/0172792 A1 11/2002 Jarvis et al.
2002/0175433 A1 11/2002 Day
2003/0232933 A1 12/2003 Lagneaux et al.
2004/0118018 A1 6/2004 Dua
2005/0003139 A1 1/2005 Keller
2006/0084339 A1 4/2006 Webb et al.
2006/0180067 A1 8/2006 Yamazaki et al.
2007/0048523 A1 3/2007 Pollet et al.
2007/0049153 A1 3/2007 Dunbar et al.
2007/0082165 A1 4/2007 Barrett
2007/0298671 A1 12/2007 Noda et al.
2008/0081854 A1 4/2008 Wang et al.
2008/0114093 A1 5/2008 Lagneaux et al.
2008/0254253 A1 10/2008 Gallager
2009/0151397 A1 6/2009 Sturman et al.
2009/0313856 A1 12/2009 Arizumi
2010/0062231 A1 3/2010 Abed et al.
2010/0199406 A1 8/2010 Dua et al.
2010/0199520 A1 8/2010 Dua et al.
2010/0203328 A1 8/2010 Hochstetter et al.
2010/0287679 A1 11/2010 Fujita et al.
2011/0151257 A1 6/2011 Wang et al.
2011/0232002 A1 9/2011 Wiessner
2012/0157904 A1 6/2012 Stein
2013/0059116 A1 3/2013 Peikert et al.
2013/0139294 A1 6/2013 Zetune et al.
2013/0145652 A1 6/2013 Podhajny et al.
2013/0192086 A1 8/2013 Tawney et al.
2013/0276333 A1 10/2013 Wawrousek et al.
2014/0196315 A1* 7/2014 Beye ..... D04B 21/20 428/119
2014/0245643 A1 9/2014 Huffa et al.
2015/0013188 A1 1/2015 Seamarks et al.
2015/0059209 A1 3/2015 Dekovic et al.
2015/0201707 A1 7/2015 Bruce
2015/0237960 A1 8/2015 Mallen et al.
2015/0282565 A1 10/2015 Kilgore
2016/0083540 A1 3/2016 Makal et al.
2016/0271904 A1 9/2016 Maia et al.
2016/0286898 A1 10/2016 Manz et al.
2016/0295971 A1 10/2016 Arnese et al.
2017/0029982 A1 2/2017 Bryson et al.
2017/0042264 A1 2/2017 Dua et al.
2017/0121854 A1* 5/2017 van der Gaag ..... D01F 1/10
2017/0129200 A1 5/2017 Adami et al.
2017/0245581 A1 8/2017 McFarland et al.
2017/0348935 A1 12/2017 Leimer et al.
2017/0362570 A1 12/2017 Revel et al.
2018/0100050 A1 4/2018 Park
2018/0125165 A1 5/2018 Adami et al.
2018/0255875 A1 9/2018 McGinnity et al.
2018/0290348 A1 10/2018 Su
2018/0319925 A1 11/2018 Lu et al.
2019/0032278 A1 1/2019 Hansen
2019/0037967 A1 2/2019 Mcfarland, II et al.
2019/0069636 A1 3/2019 Lang et al.
2019/0082774 A1 3/2019 Tamm et al.
2019/0098955 A1 4/2019 Bruce
2019/0116927 A1 4/2019 Constantinou et al.
2019/0203389 A1 7/2019 Liu
2019/0313738 A1 10/2019 Dorjgurkhem et al.

FOREIGN PATENT DOCUMENTS

CA 2489217 A1 12/2003
CA 2483333 A1 4/2005
CA 2905879 A1 9/2014
CN 2572782 Y 9/2003
CN 102162164 A 8/2011
EP 0629721 A2 12/1994
EP 1571938 A1 9/2005
EP 1573107 A2 9/2005
EP 1591572 A1 11/2005
EP 1884582 A1 2/2008
EP 2013282 B1 1/2010
EP 2530195 A1 12/2012
EP 2488685 B1 11/2014
EP 2978332 A1 2/2016
EP 3075277 A2 10/2016
EP 3078290 A1 10/2016
EP 3107411 A1 12/2016
EP 3128865 A1 2/2017
EP 3073849 B1 1/2019
EP 3594287 A1 1/2020
FR 1176314 A 4/1959
GB 2346624 A 8/2000
JP 10-130991 A 5/1998
JP 2006-249596 A2 9/2006
JP 2008101285 A 5/2008
JP 2009-534499 A 9/2009

(56) References Cited

FOREIGN PATENT DOCUMENTS

| | | | |
|---|---|---|---|
| KR | 10-2018-0060539 | A | 6/2018 |
| TW | I617432 | B | 3/2018 |
| WO | 00/51458 | A1 | 9/2000 |
| WO | 02/64656 | A2 | 8/2002 |
| WO | 02/68534 | A1 | 9/2002 |
| WO | 2005/052235 | A1 | 6/2005 |
| WO | 2010/141319 | A1 | 12/2010 |
| WO | 2011/124228 | A1 | 10/2011 |
| WO | 2011/127259 | A2 | 10/2011 |
| WO | 2012/073095 | A1 | 6/2012 |
| WO | 2014/085206 | A1 | 6/2014 |
| WO | 2015100369 | A1 | 7/2015 |
| WO | 2015/183348 | A1 | 12/2015 |
| WO | 2015190920 | | 12/2015 |
| WO | 2015190920 | A1 | 12/2015 |
| WO | 2016/014230 | A1 | 1/2016 |
| WO | 2017/115806 | A1 | 7/2017 |
| WO | 2017/151496 | A1 | 9/2017 |
| WO | 2018/124385 | A1 | 7/2018 |

OTHER PUBLICATIONS

International Search Report and Written Opinion for PCT/US2020/060236, mailed May 3, 2021.
International Search Report and Written Opinion for PCT/US2020/060247, mailed Mar. 23, 2021.
Written Opinion for PCT/US2020/060236, mailed Nov. 23, 2021.
Written Opinion for PCT/US2020/060247 mailed Oct. 28, 2021.
Written Opinion for PCT/US2020/061032 mailed Nov. 22, 2021.
International Search Report and Written Opinion for PCT/U32020l061032, mailed Dec. 4, 2021.
International Search Report and Written Opinion for PCT/US2020/061032, mailed Apr. 12, 2021.
Estane (Registered) 2355-75A Technical Data Sheet, <https://plastics.ulprospector.com/datasheet/e/702/estane-2355-75a-tpu>, 3 pp, accessed Jun. 29, 2020.
Estane (Registered) 58238 Technical Data Sheet, <https://plastics.ulprospector.com/datasheet/e24205/estane-58238-tpu>, 3 pp, accessed Jun. 29, 2020.
Estane (Registered) T470A Technical Data Sheet, <http://www.matweb.com/search/datasheet_print.aspx?matguid=5539b9ce32af46358433a5a5e035570c>, 1 pp, accessed Jun. 29, 2020.
European Search Report and Search Opinion received for European Application No. 22200912.8, mailed on Feb. 2, 2023, 9 pages.
Intention to grant received for European Application No. 20821564.0, mailed on Aug. 18, 2022, 6 pages.
International Search Report and Written Opinion for PCT/US2020/044624 mailed Oct. 30, 2020.
International Search Report and Written Opinion for PCT/US2020/044626 mailed Oct. 30, 2020.
International Search Report and Written Opinion for PCT/US2020/044628 mailed Oct. 30, 2020.
International Search Report and Written Opinion for PCT/US2020/044629 mailed Nov. 5, 2020.
Khonakdar, HA., et al., "Thermal and mechanical properties of uncrosslinked and chemically crosslinked polyethylene/ethylene vinyl acetate copolymer blends", Journal of Applied Polymer Science, vol. 103, Iss. 5, Dec. 19, 2006. pp. 3261-3270.
Non-Final office action received for U.S. Appl. No. 17/096,664, mailed on Jan. 17, 2024, 12 pages.
Office Action received for European Application No. 22200912.8, mailed on Feb. 7, 2024, 11 pages.
Final Office Action received for U.S. Appl. No. 17/096,664, mailed on Jul. 19, 2024, 8 pages.
Final Office Action received for U.S. Appl. No. 18/461,022, mailed on Jul. 19, 2024, 12 pages.

* cited by examiner

KNITTED COMPONENT HAVING A FOAM SURFACE FEATURE

RELATED APPLICATIONS

This application claims the benefit of four (4) U.S. Provisional Patent Applications: U.S. Provisional Patent Application No. 62/937,133, filed Nov. 18, 2019, U.S. Provisional Patent Application No. 62/937,117, filed Nov. 18, 2019, U.S. Provisional Patent Application No. 62/937,092, filed Nov. 18, 2019, and U.S. Provisional Patent Application No. 62/939,110, filed Nov. 22, 2019. Each patent application listed in this paragraph is hereby incorporated by reference in its entirety.

TECHNICAL FIELD

The present disclosure relates generally to knitted components and methods of manufacturing knitted components, for example, knitted components for use in footwear applications, apparel applications, or the like.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

BRIEF DESCRIPTION OF THE DRAWINGS

The embodiments of the present disclosure may be better understood with reference to the following drawings and description. The components in the FIGS. are not necessarily to scale, with emphasis instead being placed upon illustrating the principles of the present disclosure. Moreover, in the figures, like referenced numerals designate similar or identical features in certain instances.

DETAILED DESCRIPTION

Figure 1:
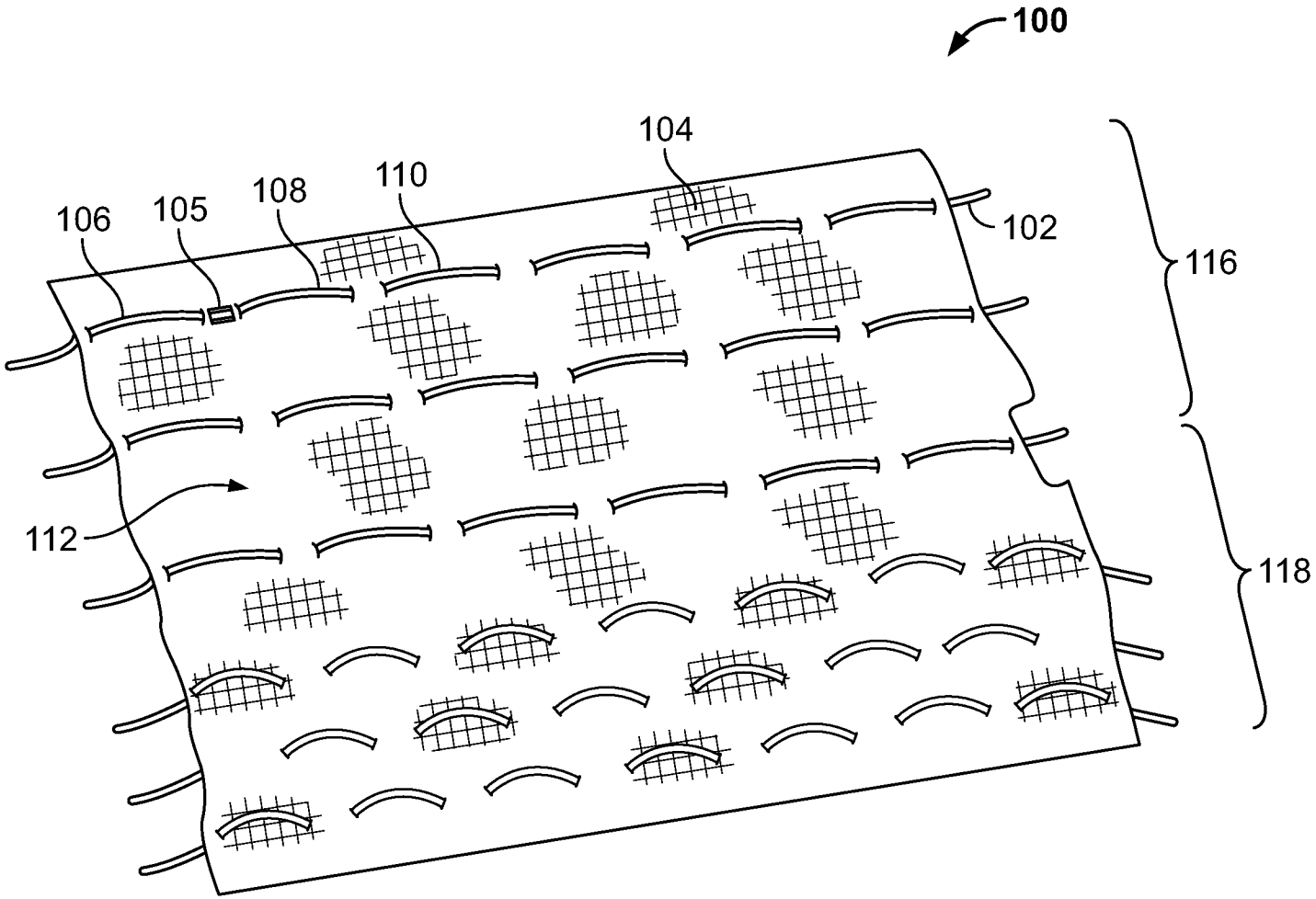
FIG. 1 is an illustration showing a knitted component including an inlaid foamable yarn in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

The present embodiments generally relate to textiles. A textile may be defined as a structure manufactured from fibers, filaments, or yarns characterized by flexibility, fineness, and a high ratio of length to thickness. Textiles generally fall into two categories. The first category includes textiles produced directly from webs of filaments or fibers by randomly (or non-randomly) interlocking or interconnecting to construct non-woven fabrics and felts. The second category includes textiles formed through a mechanical manipulation of yarn(s) (e.g., by interlacing or interlooping), thereby producing a woven fabric or a knitting fabric, for example.

Textiles may include one or more yarns. In general, a yarn is defined as an assembly having a substantial length and relatively small cross-section that is formed of at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed of a single filament, which is conventionally referred to as a "monofilament yarn," or a plurality of individual filaments grouped together. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

Figure 8:
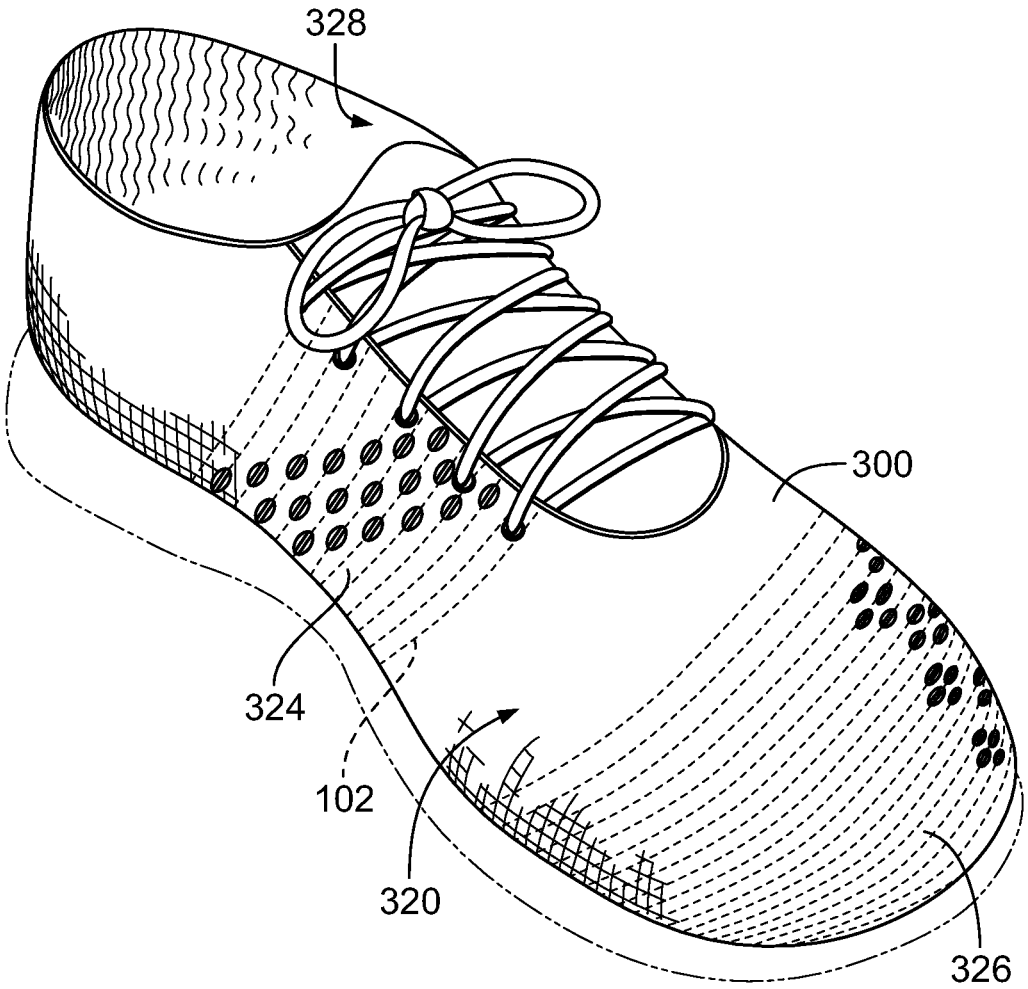
FIG. 8 is an illustration showing an upper for an article of footwear having an inlaid foamable yarn in accordance with certain aspects of the present disclosure.

While the present embodiments may be formed with any type of textile, the following description is generally related to knitted textiles, or "knitted components." For example, referring to FIG., certain articles may be at least partially formed as, and potentially fully formed as, a knitted component 100. Advantageously, forming articles that include a knitted component 100 may impart advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The weight of the article (e.g., such as an upper 300 as shown in FIG. 8, and thus the overall weight of the article of footwear), may be reduced with respect to alternative articles (e.g., traditional non-knitted uppers and/or other components that are typically used in footwear). The knitted component 100 may also provide desirable aesthetic characteristics by incorporating yarns having different colors, textures or other visual properties arranged in a particular pattern. The yarns themselves and/or the knit structure formed by one or more of the yarns of the knitted components may be varied at different locations to provide different knit portions with different properties.

In some embodiments, and referring to FIG. 1, the knitted component 100 may include at least one foamable yarn 102 when it is knitted and removed from a knitting machine. Additionally, the knitted component 100 may include a plurality of first yarns 104 that form a plurality of courses and/or a plurality of intermeshed loops of the knitted component 100 (e.g., where references to a "second yarn" may refer to the foamable yarn 102). For example, the first yarns 104 may be formed of a polyester material and/or another suitable material appreciated by those with skill in the art. The first yarns 104 may not be foamable yarns. Herein, a foamable yarn 102 may be defined herein as a yarn that includes a foamable material, where the foamable material includes a thermoplastic polymer and a blowing agent. Examples of foamable yarns are described in U.S. Provisional Application No. 62/937,092, filed Nov. 18, 2019, and entitled "FOAMABLE YARNS, TEXTILES AND ARTICLES INCORPERATING FOAMABLE YARNS, AND THE PROCESS OF MANUFACTURING THE SAME," which is incorporated in the above description.

As described herein, a thermoplastic material (e.g., a thermoplastic polymer) is a substance that may become plastic on heating and hardens when cooling without undergoing a chemical transformation. The thermoplastic polymer may comprise a natural polymeric material, a regenerated material, a synthetic polymeric material, or some combination thereof.

The natural polymeric materials may be either plant-derived or animal-derived. Plant-derived natural polymeric materials may include cotton, flax, hemp, jute, or similar. Animal-derived natural polymeric materials may include spider silk, silkworm silk, sheep wool, alpaca wool, or similar. The regenerated material is created by dissolving the cellulose area of plant fiber in chemicals and making it into fiber again (by viscose method). Since it consists of cellulose like cotton and hemp, it is also called "regenerated cellulose fiber." The regenerated material may include materials such a rayon and modal, among others.

The synthetic polymeric material may include any of a variety of homopolymers or copolymers or a combination of homopolymers and copolymers. For instance, the thermoplastic polymer may comprise: a thermoplastic polyurethane homopolymer or copolymer; a thermoplastic polyethylene homopolymer or copolymer; a thermoplastic polypropylene homopolymer or copolymer; a thermoplastic polyester homopolymer or copolymer; a thermoplastic polyether homopolymer or copolymer, a thermoplastic polyamide homopolymer or copolymer; or any combination thereof. These may include homopolymers or copolumers of polyethylene terephtalates, ethylene-vinyl acetates, Nylons, such as Nylon 6, Nylon 11, or Nylon 6,6, among others.

Additionally, in other embodiments the thermoplastic material comprises a thermosetting thermoplastic material. As described herein, a thermosetting material may cure when exposed to specific thermosetting conditions at which point the thermosetting thermoplastic material undergoes a chemical change. A thermosetting material is uncured and, thus, may be thermoplastic. The cured thermosetting material has undergone a chemical change and is thermoset. The thermosetting conditions that trigger the thermosetting thermoplastic material to cure may include a specific temperature, an amount of UV light exposure, actinic radiation, microwave radiation, radiowave radiation, electron beam radiation, gamma beam radiation, infrared radiation, ultraviolet light, visible light, or a combination thereof, among other conditions.

In some embodiments, the thermosetting thermoplastic material further comprises a cross-linking agent. As understood in the art, cross-linking agents are chemical products that chemically form bonds between two hydrocarbon chains. The reaction can be either exothermic or endothermic, depending on the cross-linking agent used. One skilled in the art would be able to select any number of appropriate cross-linking agents that would be compatible with the thermoplastic polymer and allow for cross-linking of the thermoplastic material under the desired processing conditions including temperature, pressure, UV light exposure, and the like.

In some instances a suitable cross-linking agent comprises a homobifunctional cross-linking agent. Homobifunctional reagents consist of identical reactive groups on either end of a spacer arm. Examples of homobifunctional cross-linking agents include: dimethyl pimelimidate dihydrochloride, 3,3'-dithiodipropionic acid di(N-hydroxysuccinimide ester), suberic acid bis(3-sulfo-N-hydroxysuccinimide ester) sodium salt, among others.

In other instances, a suitable cross-linking agent comprises a heterobifunctional cross-linking agent. Heterobifunctional cross-linking agents have two distinct reactive groups, allowing for cross-linking reactions to progress in a controlled, two-step reaction. This can reduce the prevalence of dimers and oligomers while crosslinking. Examples of heterobifunctional cross-linking agents include: S-acetylthioglycolic acid N-hydroxysuccinimide ester, 5-azido-2-nitrobenzoic acid N-hydroxysuccinimide ester, 4-azidophenacyl bromide, bromoacetic acid N-hydroxysuccinimide ester, N-(3-Dimethylaminopropyl)-N'-ethylcarbodiimide hydrochloride, N-(3-Dimethylaminopropyl)-N'-ethylcarbodiimide hydrochloride, N-(3-dimethylaminopropyl)-N'-ethylcarbodiimide hydrochloride, N-(3-dimethylaminopropyl)-N'-ethylcarbodiimide hydrochloride purum, N-(3-dimethylaminopropyl)-N'-ethylcarbodiimide hydrochloride, iodoacetic acid N-hydroxysuccinimide ester powder, among others.

The foamable material of the foamable yarn 102 further comprises a blowing agent. As understood in the art, blowing agents are substances that decompose or vaporize at an activation temperature to produce quantities of gases or vapors. Accordingly, they can be categorized as either chemical or physical blowing agents. A chemical blowing agent is a compound which can release a gas at its activation temperature. Generally, this released gas does not chemically react with the thermoplastic polymer serving as the polymer matrix. The process of evolving gas from the blowing agent is usually exothermic; however, certain compounds that decompose through thermal dissociation, such as bicarbonates, evolve gas in a reversible and endothermic reaction. Chemical blowing agents can be further subcategorized as inorganic and organic agents. Inorganic blowing agents are used mainly in rubber technology but may be used in plastic applications to create additional cross-linking during the blowing process.

A physical blowing agent is a compound which can phase transition to a gas when the temperature, pressure, or temperature and pressure are changed. At a given pressure, the temperature at which the physical blowing agent transitions to a gas is the activation temperature. Physical blowing agents include low-boiling-point hydrocarbons or supercritical fluids.

The choice of blowing agent can influence foam quality, density, homogeneity, and the costs of the foamed product. As discussed below, the characteristic property of these compounds is their decomposition temperature, which determines their practical use as blowing agents for a given thermoplastic material and for its processing conditions. In order for the yarn to be able to form a stable foam, the thermoplastic material must be deformable or plastic at the activation temperature of the blowing agent. To that end, the thermoplastic-material deformation temperature may be lower than the blowing-agent activation temperature.

In some embodiments, the thermoplastic-material deformation temperature is greater than about 10 degrees Celsius below the blowing-agent activation temperature. In some embodiments, the thermoplastic-material deformation temperature is greater than about 20 degrees Celsius below the blowing-agent activation temperature. In other embodiments, the first thermoplastic material 110 has a softening temperature from about 50 degrees Celsius to about 145 degrees Celsius.

In some embodiments, the chemical blowing agent has an activation temperature that is at least 5 degrees Celsius above a melting temperature of the first thermoplastic material. In other embodiments, the activation temperature of the blowing agent is at least 10 degrees Celsius above the melting temperature of the first thermoplastic material. In further embodiments, the activation temperature of the blowing agent is at least 20 degrees above the melting temperature of the first thermoplastic material.

Other properties that may be considered when selecting a chemical blowing agent include the following: affinity with the thermoplastic polymer, maximum production of gases; activation temperature at which the blowing agent evolves gas, rate of gas evolution, toxicity, corrosiveness, odor of decomposition products, effect of decomposition products on the color and other physicochemical properties of the thermoplastic polymer, cost, availability, stability against decomposition during storage, and others.

In some embodiments, the blowing agent comprises a chemical blowing agent. In some embodiments, the chemical blowing agent comprises sodium bicarbonate, ammonium carbonate, ammonium bicarbonate, calcium azide, azodicarbonamide, hydrazocarbonamide, benzenesulfonyl hydrazide, dinitrosopentamethylene tetramine, toluenesulfonyl hydrazide, p,p'-oxybis(benzenesulfonylhydrazide), azobisisobutyronitrile, barium azodicarboxylate, or any combination thereof.

In some embodiments, the blowing agent comprises a physical blowing agent. In addition to partially halogenated fluorochlorohydrocarbons, hydrocarbons (e.g. isobutene and pentane) and inert gases, such as carbon dioxide or nitrogen, can serve as physical blowing agents. Inert gases offer many advantages, including, low environmentally harmful outputs, low gas consumption, increased foam volume per weight of blowing agent used, high cost-effectiveness, non-flammable, non-toxic, chemically inert, minimal or no residues left behind in the polymeric foam after processing. Additionally, carbon dioxide has the advantage of having a higher solubility in many thermoplastic polymers than other inert gases, such nitrogen.

In some embodiments, the blowing agent is present in the first thermoplastic material in an amount effective to foam the first thermoplastic material into a multicellular foam structure when the foamable yarn 102 is processed (as discussed in more detail below). The amount of blowing agent may be measured as the concentration of blowing agent by weight in the thermoplastic material. An amount of blowing agent is considered effective when activating the blowing results in at least a 10 percent increase in the volume of the thermoplastic material.

In some embodiments, more than one blowing agent may be used. The combination of blowing agents may comprise at least two chemical blowing agents, at least two physical blowing agents, or a combination of a physical blowing agent and a chemical blowing agent. Each blowing agent has an activation temperature at the given processing pressure. These activations temperatures may be about the same or may differ. By utilizing blowing agents with different activation temperatures, processing of a foamable yarn into a multicellular foam structure can take place over a larger operation window of temperatures. Additionally, by controlling the temperature to activate a first blowing agent and then increasing the temperature of the foamable yarn to activate the second blowing agent, a variety of different desirable foam structures can be achieved. In some embodiments, two blowing agents may have activation temperatures that differ by at least about 5 degrees Celsius. In some embodiments, two blowing agents may have activation temperatures that differ by at least about 10 degrees Celsius. In some embodiments, two blowing agents may have activation temperatures that differ by at least about 20 degrees Celsius.

A wide range of additives may also be used in the foamable yarn 102. For example, catalysts speed up the reaction or, in some cases, reduce the reaction initiation temperature. As discussed above, blowing agents that form gas bubbles in the polymer or polymerizing mixture produce foam. Surfactants may be added to control the size of bubbles. Other additives that may be used include cross-linking agents, chain-extending agents, fillers, flame retardants and coloring materials (such as dyes or pigments), ultraviolet light absorbers, antioxidants, lubricants, plasticizers, emulsifiers, rheology modifier, odorants, deodorants, or halogen scavenger, depending on the application.

The molecular structure, amount, and reaction temperature of each ingredient determine the characteristics and subsequent use of the foamable yarn 102 after processing. Therefore, each formulation may be designed with the proper ingredients to achieve the desired properties of the final material. By way of an example, different blowing agents may require additional additives to maintain thermal properties. Ultimately, the density of the foam after the foamable yarn 102 is processed is determined by the number and size of the cells, which is affected, at least in part, by the amount of blowing that takes place during processing. By mixing different combinations of the starting materials, the rates of the reactions and overall rate of cure during processing can be controlled.

In some embodiments, the foamable yarn 102 may include a core having a material that is different from the foamable material. Advantageously, the core of the foamable yarn 102 may remain in substantially in-tact when subjected to an amount of heat for processing the yarn such that, even when the foamable material is softened due to its thermoplastic component being heated, the core of the foamable yarn 102 may retain structural integrity such that the core and/or the processing foamable material (and/or resulting foam) remains in a desirable location. Examples of core materials and structure are described in U.S. Provisional Application No. 62/937,092, which is incorporated by reference in the above description.

At least a portion of the foamable yarn 102 may be inlaid between certain loops of the knitted component 100 on a knitting machine during the manufacturing of the knitted component 100. For example, the foamable yarn 102 may be inserted within a course of the knitted component during on a knitting machine, such as by utilizing an inlay process. For example, an inlay process may include using an inlay feeder or other mechanical inlay device on a knitting machine (e.g., a combination feeder) to place the foamable yarn 102 between two needle beds (e.g., front and back needle beds) during a knitting process. One example of an inlay process, along with a combination feeder for enabling such a process, is described in U.S. Patent Application Publication No. 2013/0145652, published Jun. 13, 2013, and having an applicant of NIKE, Inc., which is hereby incorporated by reference in its entirety. While inlaying the foamable yarn 102 may be desirable, it is contemplated that the foamable yarn 102 may be attached to the remainder of the knitted component 100 in a different way, such as by using an adhesive to secure the foamable yarn 102 directly to the exterior surface of the knitted component 100, by embroidering or otherwise sewing the foamable yarn 102 such that it extends through the knitted component 100, etc. Further, while not shown, it is contemplated that the foamable yarn may be included in at least one of the loops forming the courses of the knitted component 100.

Still referring to FIG. 1, in some embodiments, certain portions of the foamable yarn 102 may be exposed on an outer surface 112 of the knitted component 100. For example, the knitted component 100 includes a first portion 106 of the foamable yarn 102 that is located on the surface 112 (e.g., such that it is accessible from an external perspective). Similarly, a second portion 108, third portion 110, etc. are exposed on the outer surface 112. The portion of the foamable yarn 102 between the first portion 106 and the second portion 108 (e.g., a depicted "covered portion 105") may be located beneath the outer surface 112 such that it is substantially covered by at least one loop of the first yarn 104. Advantageously, and as described in more detail below, this exposure of the foamable yarn 102 may allow a foam protrusion and/or another foam surface characteristic to be formed on the surface 112 upon post-knit processing, for example. In some applications, the portion of the foamable yarn 102 that remains beneath the surface 112 may be substantially protected from the processing stimulus (e.g., heat) since it is covered by loops of the knitted component 100. However, the covered portion of the foamable yarn 102 may still be at least partially processed (but, in certain embodiments, foam expansion may be limited by the surrounding knit structure, for example). Particular examples of knitting methods for exposing the first portion 106, second portion 108, etc. on the surface 112 are discussed below with reference to FIGS. 10-14.

Still referring to FIG. 1, multiple inlaid foamable yarns 102 may be included (e.g., extending substantially parallel as shown, or not). For example, the different inlaid foamable yarns 102 may extend through different courses of the knitted component 100 formed by the first yarns 104. While the foamable yarns 102 are shown as being a consistent yarn type in FIG. 1, it is contemplated that different types of foamable yarns 102 may be included. For example, certain areas of the knitted component 100 may include a yarn with a relatively high density of the foamable material per unit length relative to other areas that are constructed similarly from a knitting perspective. For example, certain exposed areas (and, the result protrusions) may have at least 10% more, at least 20% more, at least 30% more, at least 50% more, at least 75% more, at least 100% more, or even more than other exposed areas of the foamable yarns 102. As a result, certain areas may form foam protrusions of different sizes (as discussed below). For example, the foam protrusions 212 may have a height of at least 2 mm, such as at least 5 mm, 10 mm, 20 mm, or greater. Regarding length and width, the protrusions may be at least 2 mm in length and/or width, such as at least 5 mm, 10 mm, 20 mm, or greater.

Additionally or alternatively, it is contemplated that different knitting techniques may be used to control the amount of surface exposure of the foamable yarns 102. In FIG. 1, for example, a first area 116 of the knitted component 100 includes exposed portions that are longer than exposed portions in the second area 118. Once processed, foam protrusions formed in the first area 116 will generally be larger in at least one dimension (e.g., at least longer) than foam protrusions formed in the second area 118 since more of the foamable material is exposed on the surface 112 in the first area 116 relative to the second area 118.

Figure 2:
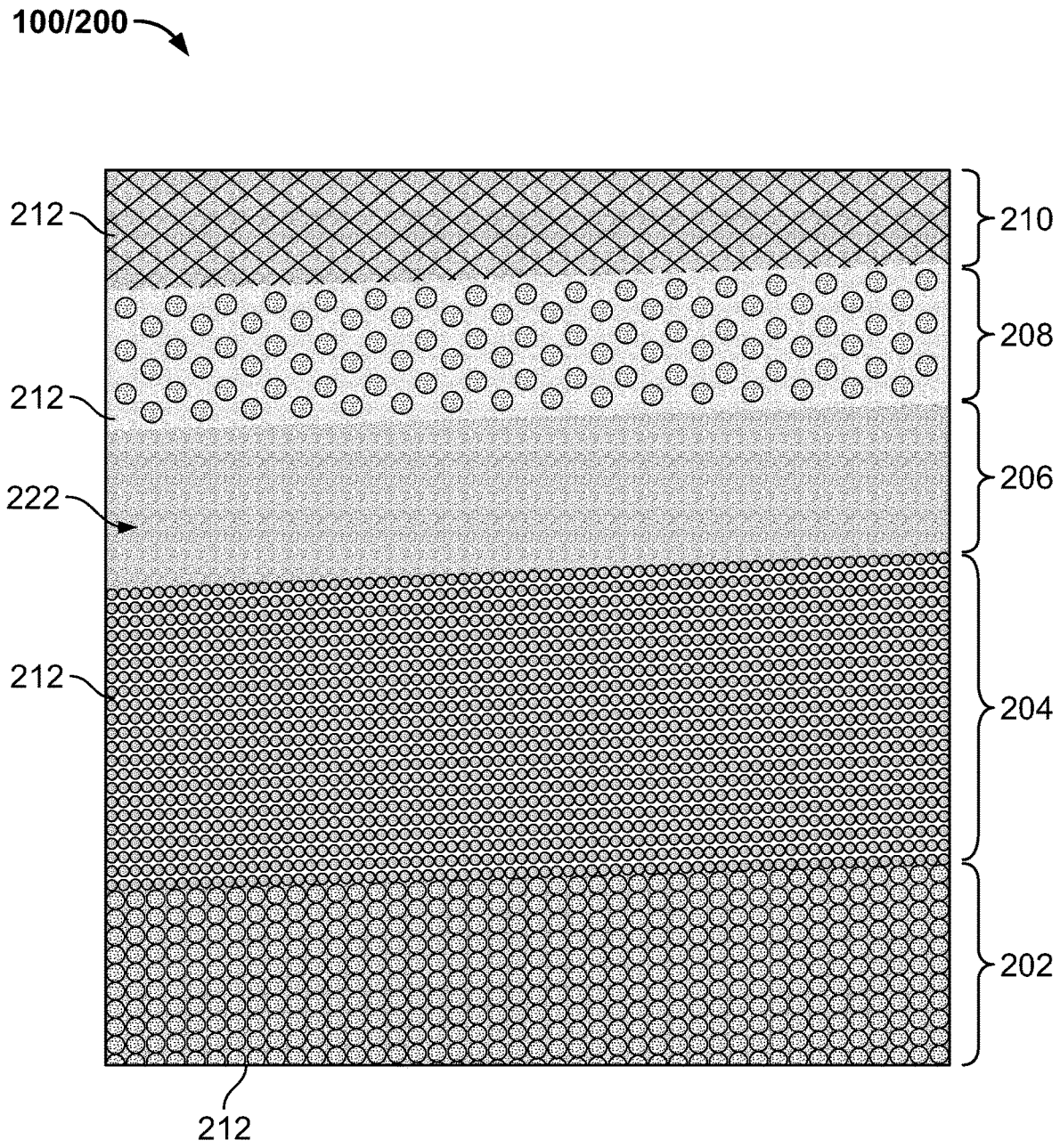
FIG. 2 is an illustration showing an article having a knitted component with foam protrusions extending from a surface thereof in accordance with certain aspects of the present disclosure.

FIG. 2 shows an example of an article 200, which may be initially formed as a knitted component in a manner similar to the knitted component 100 depicted by FIG. 1. Referring to FIG. 2, the article 200 may generally include five (5) regions. A first region 202 may include a plurality of foam protrusions 212. The foam protrusions 212 may include a multicellular foam formed as the reaction product of foaming the above-described foamable yarn 102, for example. In particular, referring to the exposed portions 106, 108, etc. of FIG. 1, the exposed portions may be exposed to a particular amount of heat and/or another stimulus to activate the foamable material after the knitted component 100 of FIG. 1 is formed. Particular activation parameters are described in detail in U.S. Provisional Application No. 62/937,092, which is incorporated by reference above. As the foamable material is activated, it may expand (e.g., away from the surface 112 of FIG. 1) and then set or harden in an expanded state as it is allowed cool (or otherwise obtain a relatively permanent material state). The resulting structures may be protrusions, such as the foam protrusions 212 that form a particular surface topography.

As shown in FIG. 2, the first region 202 may include protrusions 212 that are substantially the same size, but this is optional. The first region 202 may alternatively have variable amount of foamable material exposed on the surface of the knitted component, and/or may alter the processing procedure in different areas of the first region 202, such that the protrusions 212 vary. The protrusions 212 may form a surface pattern optimized for a certain function, for example.

The second region 204 of FIG. 2 is similar to the first region 202, but the protrusions 212 are slightly smaller. This may be accomplished by either altering the knitting process (e.g., by exposing less of a foamable yarn inlay on a surface) and/or by switching types of the foamable yarn during knitting. Similarly, the fourth region 208 and the fifth region 210 include protrusions 212 that are relatively spaced apart (e.g., by separating the exposed portions of the inlaid foamable yarns) and relatively low in height, respectively. A variety of additional and/or alternative patterns may be used. Further, while all of the protrusions 212 in FIG. 2 are substantially hemispherical in shape, it is contemplated that the shape of the protrusions 212 could be altered by utilizing specific knit structures, specific material types, by using a mold press or other similar device during the foam activate step, or by any other suitable method.

The third region 206 of FIG. 2 includes a foam surface 222 that is substantially formed of foam (e.g., the reaction product of the foamable yarn 102). The foam surface 222 may be formed via a variety of methods. For example, the foamable material used in the foamable yarn may have a high enough concentration such that the foam fully covers the outer surface of the knitted component 100 once it is processed and embodies an expanded state. Alternatively, and as discussed in more detail below, it is contemplated that a unique knitting process may be used such that most or all of the surface 222 is formed of the foamable yarns 102 with less foam expansion (see, e.g., FIG. 12 and the associated description).

Figure 3:
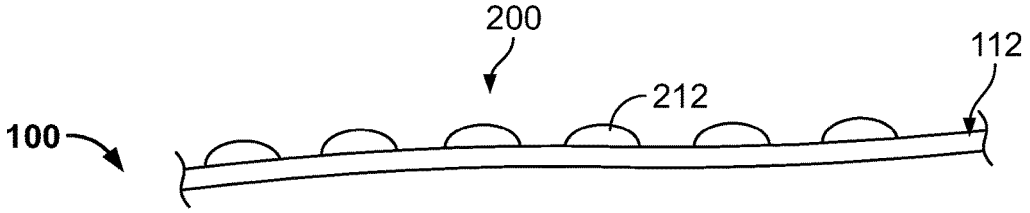
FIG. 3 is an illustration showing an article having a knitted component with foam protrusions extending from a surface thereof in accordance with certain aspects of the present disclosure.

FIG. 3-7 show various embodiments of articles 200 formed using the methods and processes described herein. For example, FIG. 3 shows an article 200 having relatively small foam protrusions 212 that extend from the surface 112 of the knitted component 100. As discussed above, location between the foam protrusions 212 may include inlaid yarns having a foamable material (e.g., such that the foamable material, and/or a foam, extends through the knitted component 100 from one protrusion 212 to the next. While the protrusions of FIG. 3 are substantially the same size, they may alternatively vary (e.g., due to using different yarns and/or by exposing different lengths of the yarns including the foamable material during knitting). While the foam protrusions 212 are shown only on one side of the fabric, they could additionally or alternatively be on the other side.

Figure 4:
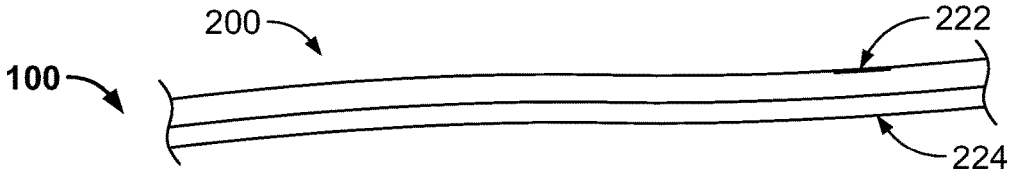
FIG. 4 is an illustration showing an article having a knitted component and a foam surface in accordance with certain aspects of the present disclosure.

FIG. 4 shows an article 200 having a foam surface 222, or a surface that is substantially covered with a multicellular foam. Such an embodiment may be formed by using a sufficient amount of foamable material within a yarn such that it substantially covers the knitted loops once it expands due to post-knit processing, for example. While the foam surface 222 is formed on only one side of the article 200 in the depicted embodiment, the opposite surface 224 may additionally or alternatively be covered in a foam (e.g., once the knitted component is processed such that the foamable yarn forms the foam).

Figure 5:
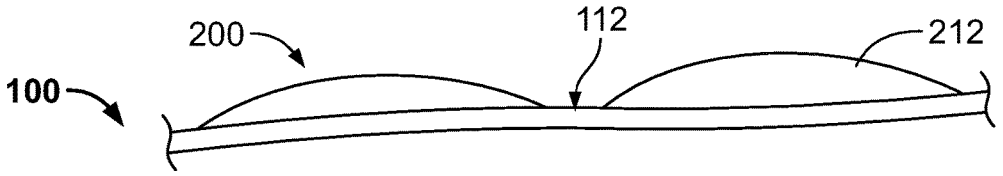
FIG. 5 is an illustration showing an article having a knitted component with foam protrusions extending from a surface thereof in accordance with certain aspects of the present disclosure.
Figure 6:
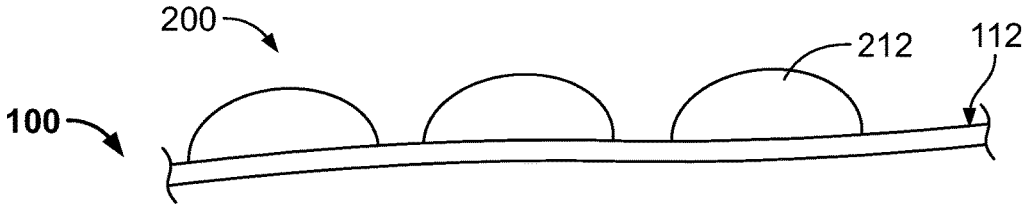
FIG. 6 is an illustration showing an article having a knitted component with foam protrusions extending from a surface thereof in accordance with certain aspects of the present disclosure.

FIGS. 5-6 are similar to FIG. 3, but the foam protrusions are different sizes. For example, in FIG. 5, the foam protrusions 212 are about the same height as the foam protrusions 212 of FIG. 3, but they are longer (e.g., due to foamable yarns being exposed for a longer distance). In FIG. 6, the foam protrusions are substantially taller than those of FIG. 3 or FIG. 5. This may be accomplished by utilizing a foamable yarn having more of the foamable material per unit length, and or by processing the foamable yarn differently to achieve a relatively high degree of expansion.

Figure 7:
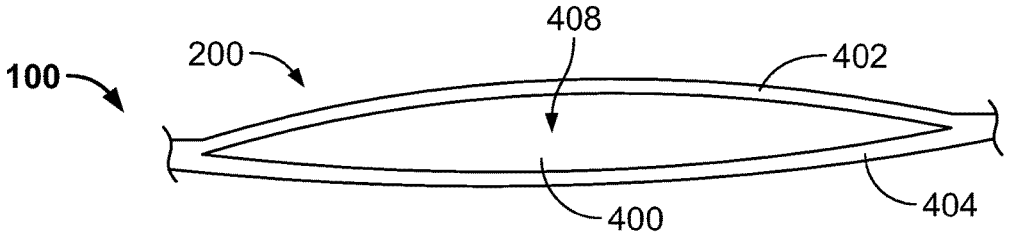
FIG. 7 is an illustration showing an article having a knitted component with a tubular knit structure forming a pocket along with a foamed interior of the pocket in accordance with certain aspects of the present disclosure.

FIG. 7 shows a different embodiment, where a multicellular foam 400 is located between a first layer 402 and a second layer 404 of the knitted component 100. For example, a foamable yarn (as described above) may be inlaid through an area having a tubular knit construction, where the first layer 402 and the second layer 404 are formed. In particular, the first layer 402 may comprise a plurality of courses formed by intermeshed loops (e.g., of the above-described "first yarn"), and similarly the second layer 404 may comprise a plurality of courses formed by intermeshed loops. A pocket 408 may be formed between the first layer 402 and the second layer 404, particularly where the loops of the first layer 402 are not directly connected to (e.g., interlooped with) the loops of the second layer 404. The pocket 408 may exist even prior to post-knit processing, and the foamable yarn may be located therein due to the inlay procedure. Once heated or otherwise processed, the foamable material of the foamable yarn may expand to fill the pocket 408. Such an embodiment may be advantageous for providing a foam cushion within a knit structure, for example, although other functions and/or uses are additionally or alternatively contemplated.

The methods and features discussed above may be incorporated into any suitable article. For example, FIG. 8 shows an upper 300 for an article of footwear that includes a plurality of foamable yarns 102. The upper 300 is shown in a pre-processed state in FIG. 8 (e.g., prior to forming the foam protrusions after the knitting process). As shown, the inlaid foamable yarns 102 may be exposed on an outer surface 320 of the upper 300 in select locations. Any suitable location may be chosen, such as in the midfoot area 324 and the toe area 326 in the depicted example (which is for illustration only). Advantageously, the foam protrusions, once formed, may provide suitable surface characteristics on the outer surface 320 of the upper 300. Without limitation, the foam protrusions may form gripping elements (e.g., suitable for kicking a soccer ball with a high degree of spin, for gripping a rope, rock wall, or other object during a particular athletic completion, etc.). If a relatively soft foam is used, it is also contemplated that the foamable yarns 102 may be exposed on an interior surface 328 of the upper 300 to provide cushioning and/or other comfort characteristics.

Figure 9:
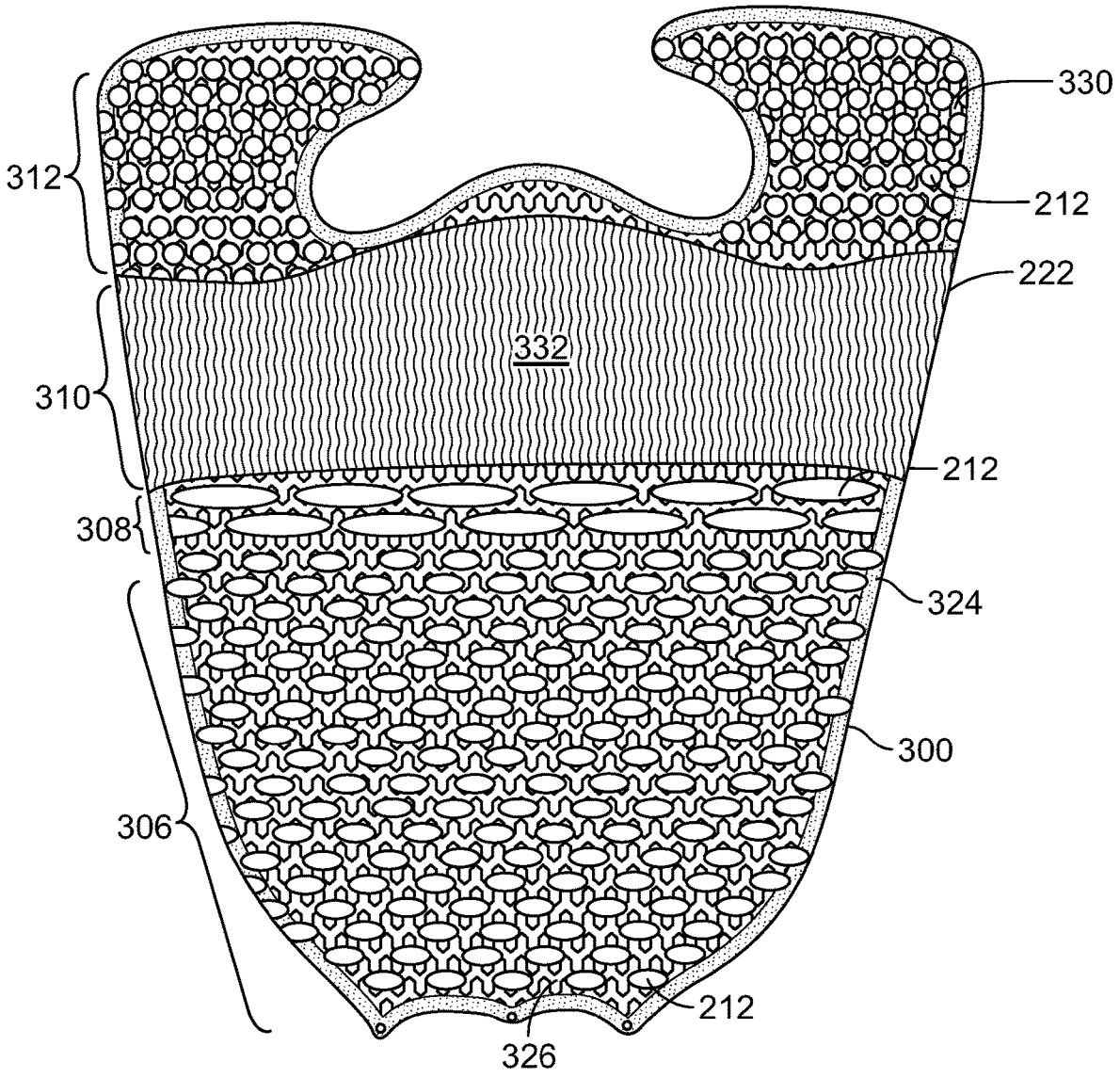
FIG. 9 is an illustration showing an upper for an article of footwear having a knitted component and foam protrusions extending from a surface thereof in accordance with certain aspects of the present disclosure.

FIG. 9 shows another embodiment of an upper 300, where the upper 300 is in a configuration that it may have just after knitting (and/or post-knit processing) but before being folded or otherwise manipulated into a wearable shape. As shown, the upper 300 may include multiple regions having different surface characteristics (e.g., similar to the embodiment of FIG. 2). The surface characteristics are formed by the foam protrusions 212, and/or the foam surface 222. As shown, the upper may include a first region 306 with a set of foam protrusions 212 covering the toe area 326. A second region 308, located in the midfoot area 324 of the upper, may include larger foam protrusion 212. A third region 310 may include a surface that is substantially formed of a multicellular foam (as discussed above), which may be advantageous for providing cushioning where a fastening system is located (e.g., where shoelaces are tightened over the throat area 332 of the upper 300, for example). The heel area 330 includes a fourth region 312 with relatively small foam protrusions 212. Notably, certain areas may lack protrusion, the regions may be re-organized, etc.

Figure 10:
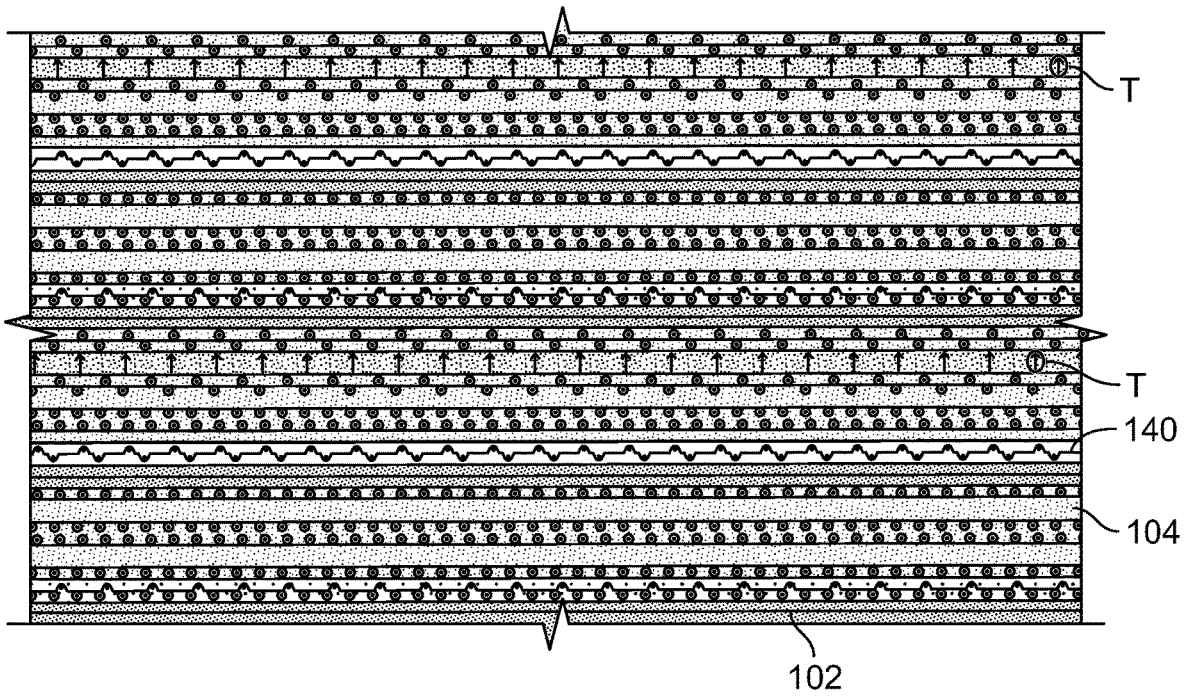
FIGS. 10-14 are illustration showing knit diagrams for forming a knitted component having an inlaid foamable yarn in accordance with certain aspects of the present disclosure.

FIGS. 10-13 show certain examples of knitting techniques that may be used to expose certain portions of an inlaid foamable yarn on a surface of a knitted component. As shown by FIG. 10, for example, an inlay jacquard procedure may be used to inlay a foamable yarn 102 within loops of a first yarn 104 (e.g., comprising a polyester and elastane in the depicted embodiment, though other suitable yarn types are also contemplated). As shown, a unique transfer process T may be utilized, which is key to ensuring that a length of the foamable yarn 102 will be exposed on a resulting surface. In particular, the transfer T causes certain loops of a course that would otherwise cover the foamable yarn 102 (e.g., where it is eventually exposed) to move to an opposite needle bed, thereby providing a hole or an "opening" where a plurality of needles are skipped on one needle bed (e.g., such that nothing covers the inlaid foamable yarn 102).

The resulting exposed length of the foamable yarn 102 may be equal to or greater than the length of a portion of a knitted course comprising at least two consecutive loops, for example, and perhaps much larger (e.g., at least three, four, five, ten, fifteen, or even twenty or more consecutive loops). In metric units, this exposed length may be equal to at least 2 mm, for example, and potentially much larger (e.g., about equal to or greater than 5 mm, 10 mm, 20 mm, or more). The process of FIG. 10 may correspond to the first region 202 of FIG. 2, for example. A fusible yarn 140 may additionally be included, which may cover and then "release" certain portions of the foamable yarn 102, for example (as described with reference to FIG. 12). The fusible yarn 140 may additionally or alternatively be included to provide rigidity, strength, and/or other advantageous features to the knitted component once processed with heat (which may be the same heat used to activate the foamable yarn, for example).

Figure 11:
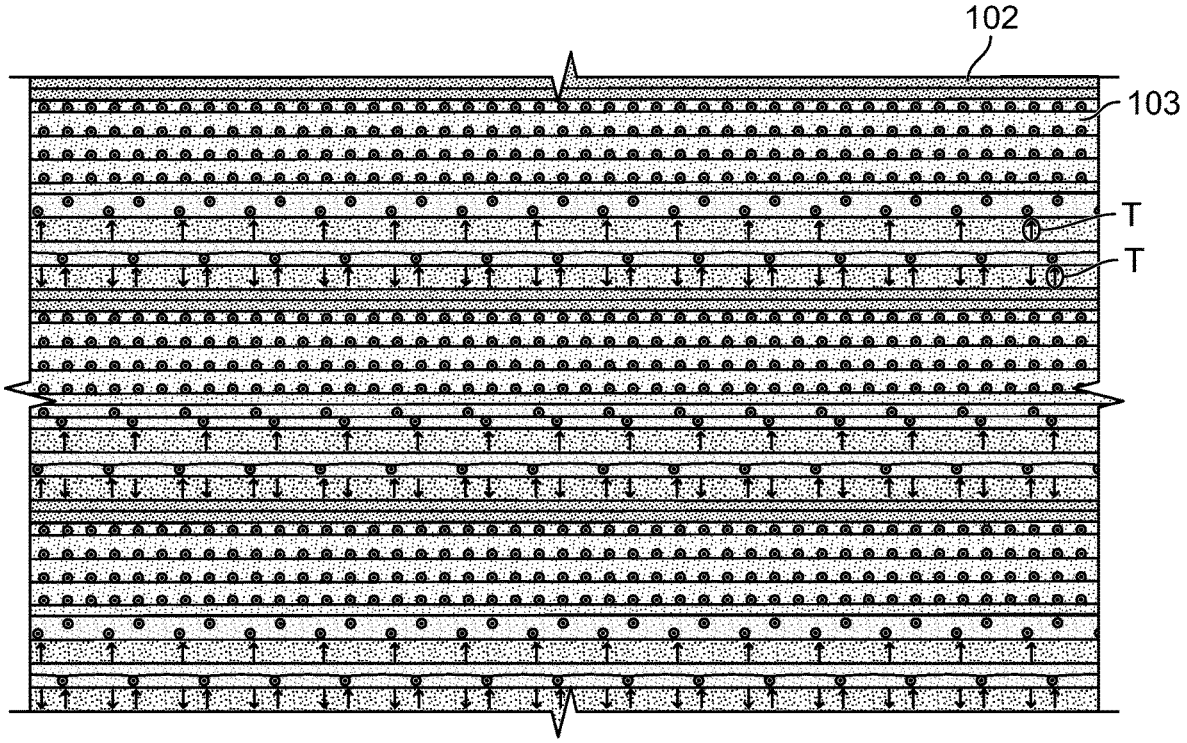
Figure 13:
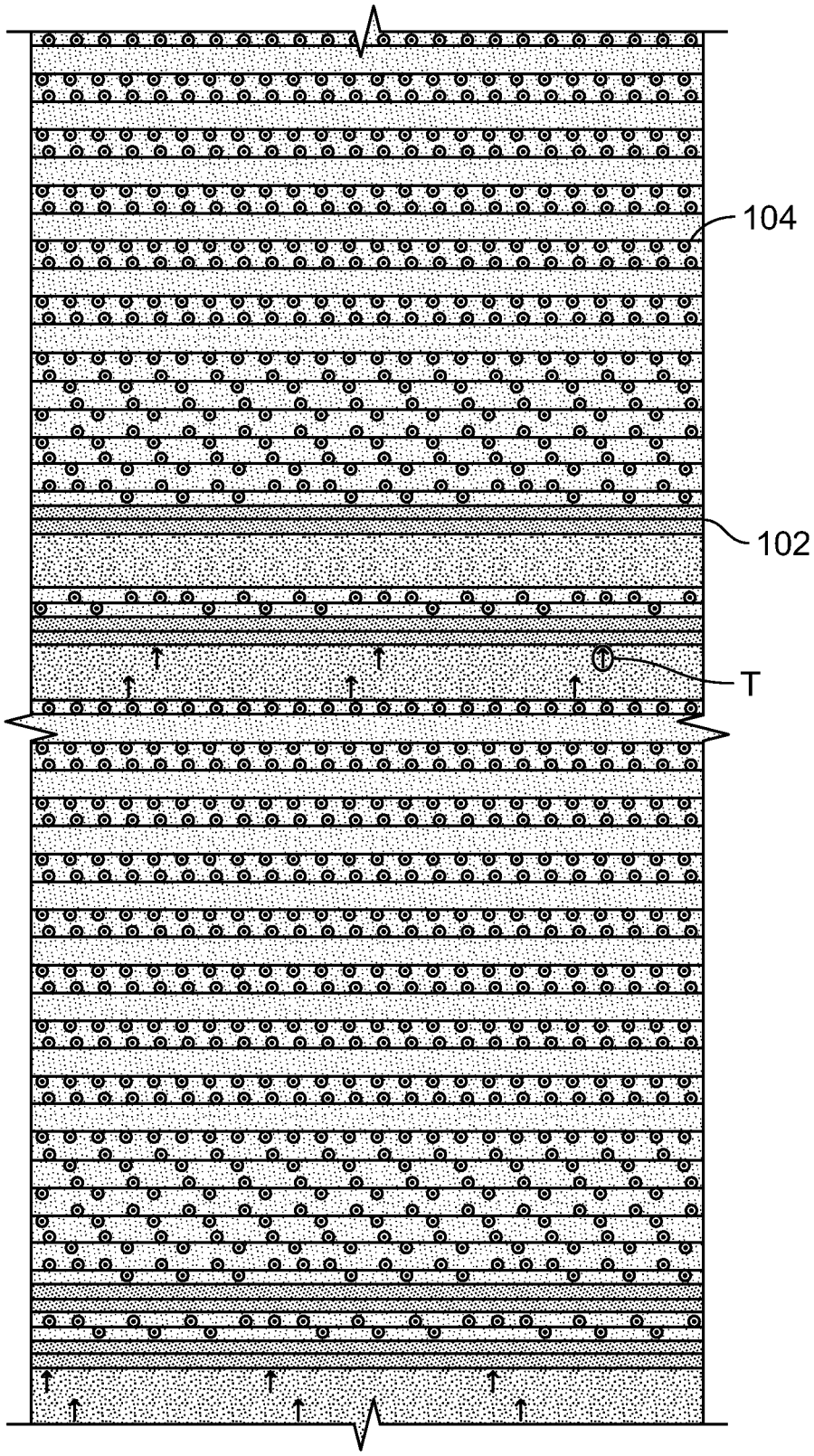
Figure 14:
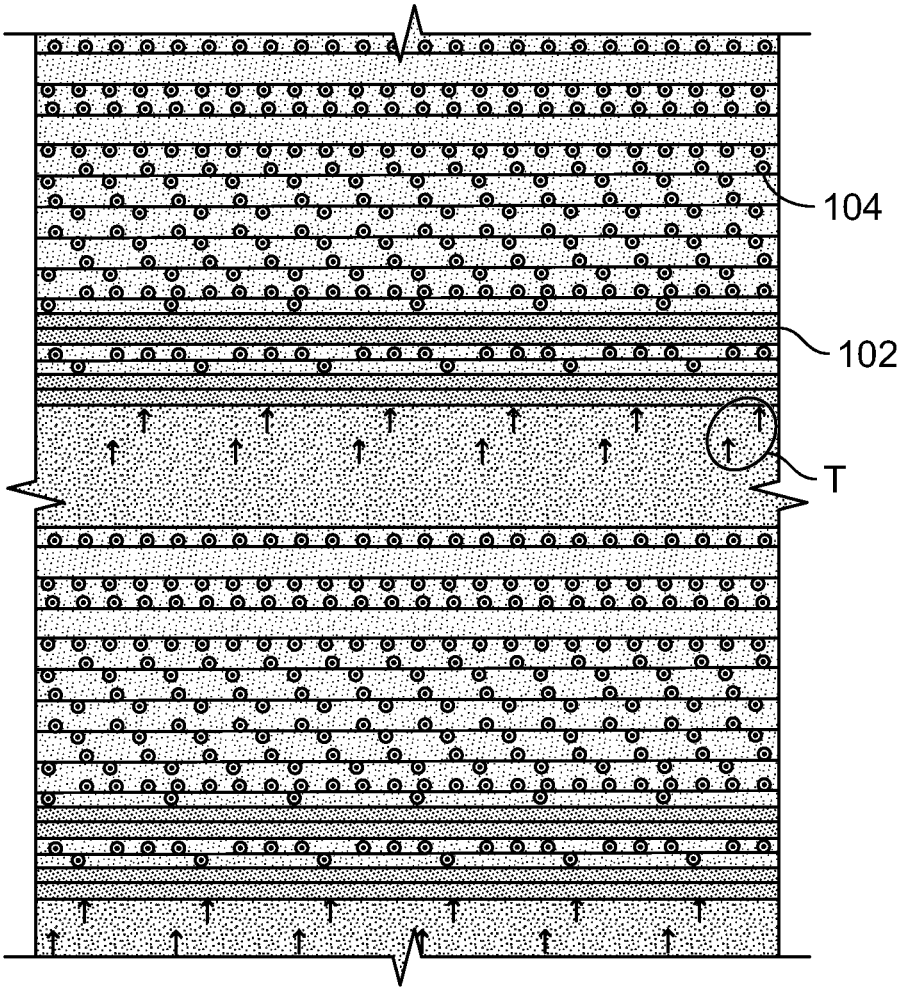

FIGS. 11 and 13-14 show processes that may form similar knit structures to the structure formed by FIG. 10, for example, and the general principle used to form exposed portions of the foamable yarn 102 remains the same (e.g., by utilizing a transfer T). In particular, FIGS. 11 and 13-14 may correspond to the regions 204, 208, and 210, of FIG. 2, respectively. However, one skilled in the art will appreciate that a variety of alterations may be made to provide the knitted component with optimal characteristics. For example (and without limitation), other yarns may be included, such as a high tenacity yarn 103 shown in FIG. 11, which may provide a high degree of strength and rigidity.

Figure 12:
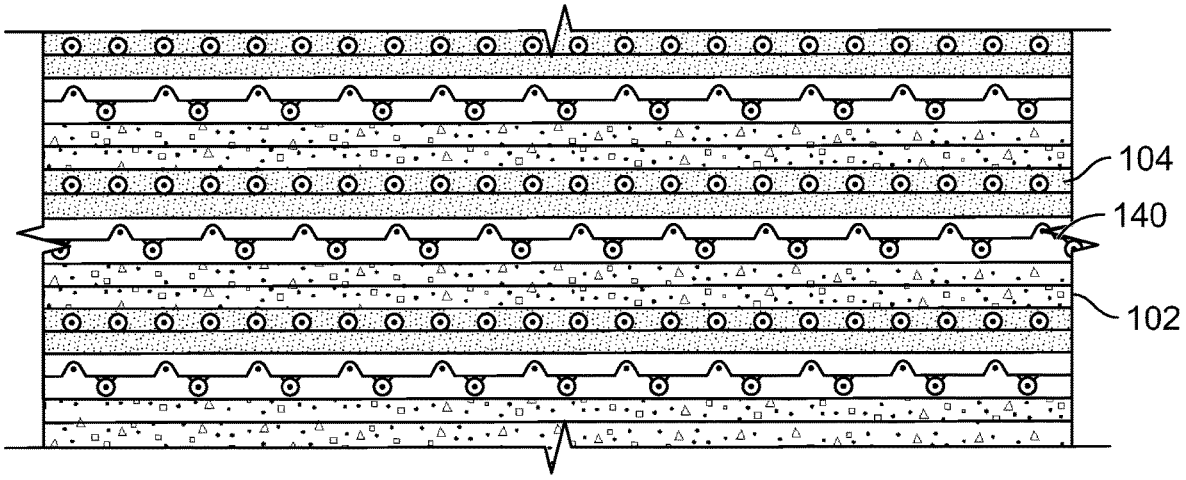

FIG. 12 is a knitting procedure that may be used to form a surface fully or substantially formed by a foam (e.g., once processed). In FIG. 12, the foamable yarn 102 is inlaid between courses formed by a first yarn 104 (e.g., a polyester or other high-melting-point yarn, potentially including an elastane, for example) and a fusible yarn 140 (e.g., formed of a thermoplastic material having a relatively low melting point suitable for heat processing). Uniquely, the only loops formed on the front side of the inlaid foamable yarn 102 are formed solely of the fusible yarn 140. Once removed from the knitting machine, the resulting knitting component may appear similar to other knitted components described using the knit processes depicted above. However, once heated, the fusible yarn 140 may substantially or fully melt, thereby allowing the foamable material of the foamable yarn 102 to "release" due to deformation of the fusible yarn 140. As a result, the foamable material may substantially or wholly cover the respective side of the fabric, thereby forming a foam surface similar to as described above (see, e.g., the third region 206 of FIG. 2 and the third region 310 of FIG. 9).

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

The subject-matter of the disclosure may also relate, among others, to the following aspects:

In a 1st aspect. a knitted component, comprises the following: a first area.

where the first area includes a plurality of knit loops comprising a first yarn; and a second yarn at least partially inlaid within the first area of the knitted component such that the second yarn extends between at least a first loop and a second loop of the plurality of knit loops, where the second yarn includes a foamable material comprising a blowing agent and a thermoplastic polymer.

A 2nd aspect includes the knitted component of aspect 1, where the second yarn includes a first portion that is exposed on a first surface in the first area.

A 3rd aspect includes the knitted component of aspect 2, where the first portion has a length that is greater than or equal to the length of a portion of a first course that includes at least three consecutive knit loops, the first course being in the first area.

A 4th aspect includes the knitted component of aspect 2, where the second yarn additionally includes a second portion that is exposed on the first surface in the first area, and where the second yarn includes a covered portion extending from the first portion to the second portion.

A 5th aspect includes the knitted component of aspect 4, where a length of the second portion is larger than a length of the first portion.

A 6th aspect includes the knitted component of aspect 2, where a second course extends through a second area with a second surface, where the second yarn is at least partially inlaid within the second course, and where the second yarn includes a second portion that is exposed on the second surface in the second area.

A 7th aspect includes the knitted component of aspect 6, where the second portion of the second yam includes a length that is larger than a length of the first portion of the second yarn.

An 8th aspect includes the knitted component of any of aspects 1-7, where the first area includes a tubular knit construction having a first layer and a second layer, where at least one of the first layer and the second layer includes the first yarn, and where at least a portion of the second yarn is located within a pocket between the first layer and the second layer.

A 9th aspect includes the knitted component of any of the aspects of aspects 1-8, further comprising a third yarn that is included in at least one loop of a first course, where the third yarn includes a second thermoplastic polymer, and where the second thermoplastic polymer has a melting temperature of about 120 C. or less.

A 10th aspect include a knitted component, comprising: a first area having a first surface, where the first area is at least partially formed by a first knit course, the first knit course having a plurality of loops formed by a first yarn; and a multicellular foam material at least partially surrounding the first yam in in the first area of the knitted component, where the multicellular foam material forms a first protrusion extending from the first surface of the first area.

An 11th aspect includes the knitted component of aspect 10, where the at least one protrusion includes a height of at least 2 mm.

A 12th aspect includes the knitted component of any of aspects 10-11, where the multicellular foam material is the reaction product of foaming at least a portion of a second yarn, the second yarn comprising a first thermoplastic material.

A 13th aspect includes the knitted component of any of aspects 10-12, where the at least one protrusion has a length that is at least 5 mm.

A 14th aspect includes the knitted component of any of aspects 10-13, where the at least one protrusion includes a first foam protrusion and a second foam protrusion, and where the second foam protrusion includes at least 20% more of the multicellular foam material, by mass, than the first foam protrusion.

A 15th aspect includes the knitted component of any of aspects 10-14, where the at least one protrusion includes a first foam protrusion and a second foam protrusion, and where a covered portion of a second yarn extends from the first foam protrusion to the second foam protrusion, the covered portion including at least one of the multicellular foam material and a foamable material with a blowing agent.

A 16th aspect includes the knitted component of any of aspects 10-15, where the covered portion of the second yarn is inlaid through the knitted component.

A 17th aspect includes the knitted component of any of aspects 10-16, further comprising a third yarn that is included in at least one loop of the first knit course, where the third yarn includes a second thermoplastic polymer material, and where the second thermoplastic polymer material having a melting temperature of about 120 C. or less.

An 18th aspect includes a method, comprising: knitting a course with a first yarn, where the course comprises a plurality of loops; inlaying a foamable yarn at least partially within the first course; and transferring a loop of the first course from one needle bed to another needle bed such that at least a portion of the foamable yarn is exposed on a surface of a resulting knitted component.

A 19th aspect includes the method of aspect 18, further comprising heating the knitted component such that the foamable yarn forms at least one foam protrusion on a surface of the knitted component.

A 20th aspect includes the method of any of aspects 18-19, further comprising knitting at least one loop with a fusible yarn that is separate from the foamable yarn, and further comprising heating the fusible yarn such that the fusible yarn deforms when a foamable material of the foamable yarn expands.

We claim:

1. A knitted component, comprising:

a knitted region, comprising:

a first area, a second area, and a first yarn that forms a plurality of intermeshed loops in the first area and in the second area, wherein a second yarn is at least partially inlaid within the plurality of intermeshed loops, wherein the second yarn comprises a core material and a foamable material, and wherein the foamable material of the second yarn has been expanded to thereby form a plurality of foam protrusions on a surface of at least a portion of the first area and on a surface of at least a portion of the second area, and wherein at least a portion of the plurality of foam protrusions in the first area are distinct in size and/or shape and/or spacing compared to at least a portion of the plurality of foam protrusions in the second area.

2. The knitted component of claim 1, wherein the at least a portion of the plurality of foam protrusions in the first area are distinct in size compared to the at least a portion of the plurality of foam protrusions in the second area.

3. The knitted component of claim 1, wherein the at least a portion of the plurality of foam protrusions in the first area are distinct in shape compared to the at least a portion of the plurality of foam protrusions in the second area.

4. The knitted component of claim 1, wherein the at least a portion of the plurality of foam protrusions in the first area are distinct in spacing compared to the at least a portion of the plurality of foam protrusions in the second area.

5. The knitted component of claim 1, wherein the second yarn includes a first exposed portion that is exposed on the surface of the first area.

6. The knitted component of claim 5, wherein the first exposed portion has a length that is at least 2 millimeters.

7. The knitted component of claim 5, wherein the second yarn additionally includes a second exposed portion and a covered portion, wherein the second exposed portion is exposed on the surface of the first area, and wherein the covered portion is covered on the surface of the first area, the covered portion extending on the surface of the first area from the first exposed portion to the second exposed portion.

8. The knitted component of claim 1, wherein the first area includes a tubular knit construction having a first layer, a second layer, and a pocket located between the first layer and the second layer.

9. The knitted component of claim 8, wherein at least one of the first layer and the second layer comprises the first yarn, and wherein the second yarn is inlaid within the pocket between the first layer and the second layer.

10. The knitted component of claim 1, wherein, with the second yarn, a melting temperature of the core material is higher than an activation temperature of a blowing agent of the foamable material.

11. The knitted component of claim 1, wherein at least a portion of the first area is configured such that only the first yarn is present on the surface of the first area.

12. The knitted component of claim 1, wherein, in at least a portion of the first area and/or in at least a portion of the second area, no foam protrusions are present.

13. A knitted component, comprising:

a knitted region, comprising:

a first area, a second area, and a first yarn that forms a plurality of intermeshed loops in the first area and in the second area, wherein a second yarn is at least partially inlaid within the plurality of intermeshed loops, wherein the second yarn comprises a foamed material forming a plurality of foam protrusions on a surface of the first area and on a surface of the second area, and wherein at least a portion of the plurality of foam protrusions in the first area are distinct in size and/or shape and/or spacing compared to at least a portion of the plurality of foam protrusions in the second area.

14. The knitted component of claim 13, wherein the at least a portion of the plurality of foam protrusions in the first area are distinct in size compared to the at least a portion of the plurality of foam protrusions in the second area.

15. The knitted component of claim 13, wherein the at least a portion of the plurality of foam protrusions in the first area are distinct in shape compared to the at least a portion of the plurality of foam protrusions in the second area.

16. The knitted component of claim 13, wherein the at least a portion of the plurality of foam protrusions in the first area are distinct in spacing compared to the at least a portion of the plurality of foam protrusions in the second area.

17. A knitted component, comprising:

a first surface comprising a first area and a second area;

a second surface facing opposite from the first surface;

a plurality of knit loops formed with a first yarn; and a second yarn at least partially inlaid within the knitted component such that the second yarn extends between at least a first knit loop and a second knit loop of the plurality of knit loops, wherein the second yarn comprises a core material and a foamed material, the foamed material comprising a plurality of foam protrusions that extend in at least a first direction outward from the first surface;

wherein at least a portion of the plurality of foam protrusions are located in the first area and are distinct in size and/or shape and/or spacing compared to at least a portion of the plurality of foam protrusions that are located in the second area.

18. The knitted component of claim 17, wherein the knitted component is incorporated into an article of footwear or into an article of apparel.

* * * * *